US011592780B2

(12) United States Patent
Smith et al.

(10) Patent No.: US 11,592,780 B2
(45) Date of Patent: Feb. 28, 2023

(54) COMBINATION CARTRIDGE

(71) Applicant: HEWLETT-PACKARD DEVELOPMENT COMPANY, L.P., Spring, TX (US)

(72) Inventors: Kenneth Smith, Boise, ID (US); Dean Richtsmeier, Boise, ID (US); Jeff Luke, Boise, ID (US); Mathew Lavigne, Boise, ID (US); Sean Daniel Fitzgerald, Boise, ID (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/051,756

(22) PCT Filed: Aug. 30, 2018

(86) PCT No.: PCT/US2018/048753
§ 371 (c)(1),
(2) Date: Oct. 29, 2020

(87) PCT Pub. No.: WO2020/046317
PCT Pub. Date: Mar. 5, 2020

(65) Prior Publication Data
US 2021/0240125 A1 Aug. 5, 2021

(51) Int. Cl.
*G03G 21/10* (2006.01)

(52) U.S. Cl.
CPC ..... *G03G 21/105* (2013.01)

(58) Field of Classification Search
CPC ..... G03G 21/105
See application file for complete search history.

(56) References Cited

U.S. PATENT DOCUMENTS 4,747,000 A 5/1988 Godsoe
5,045,884 A * 9/1991 Ohira ..... G03G 15/0856 399/224
5,150,162 A * 9/1992 Saito ..... G03G 15/0867 399/223
5,537,188 A * 7/1996 Haneda ..... G03G 15/01 399/112
5,640,644 A * 6/1997 Kimura ..... G03G 15/0126 399/224

(Continued)

FOREIGN PATENT DOCUMENTS

CN 1427312 A 7/2003
CN 201820081 U 5/2011

(Continued)

OTHER PUBLICATIONS

KIP, "KIP 770K User Manual", Apr. 13, 2015, Kipnews.
Oce, "Océ User manual", 2006, Canon.

*Primary Examiner* — Walter L Lindsay, Jr.
*Assistant Examiner* — Milton Gonzalez
(74) *Attorney, Agent, or Firm* — Foley & Lardner LLP

(57) ABSTRACT

An example device can include a reserve print materials container, an access port coupled to the reserve print materials container to receive, from a replenishment device, print materials directly to the reserve print materials container in-situ, and a main print materials container coupled to the reserve print materials container to receive print materials from the reserve print materials container.

18 Claims, 6 Drawing Sheets

(56) References Cited

U.S. PATENT DOCUMENTS

| | | | | |
|---|---|---|---|---|
| 5,722,013 | A * | 2/1998 | Nagase | G03G 15/011 399/112 |
| 5,754,210 | A * | 5/1998 | Haneda | G03G 15/011 347/116 |
| 5,758,232 | A * | 5/1998 | Ikunami | G03G 21/1623 399/113 |
| 5,909,604 | A * | 6/1999 | Arai | G03G 21/12 399/35 |
| 5,918,094 | A | 6/1999 | Masuda et al. | |
| 6,115,571 | A | 9/2000 | Kobayashi | |
| 6,259,874 | B1 | 7/2001 | Murakami et al. | |
| 6,792,230 | B2 * | 9/2004 | Saito | G03G 21/1821 399/111 |
| 6,862,420 | B1 * | 3/2005 | Less | G03G 15/0884 399/258 |
| 7,054,591 | B1 | 5/2006 | Wilhelm et al. | |
| 7,945,203 | B2 * | 5/2011 | Shimizu | G03G 21/105 399/360 |
| 8,682,184 | B2 | 3/2014 | Nishakawa | |
| 9,389,535 | B2 * | 7/2016 | Hotani | G03G 21/1839 |
| 2003/0118368 | A1 | 6/2003 | Saito et al. | |
| 2009/0154973 | A1 | 6/2009 | Shimizu | |

FOREIGN PATENT DOCUMENTS

| | | | | |
|---|---|---|---|---|
| DE | 19641336 | A1 | | 2/1997 |
| EP | 0686892 | | | 12/1995 |
| EP | 2416223 | | | 2/2012 |
| FR | 2809663 | A1 | | 12/2001 |
| JP | 05173397 | A | * | 7/1993 |
| JP | H 07-5740 | A | * | 1/1995 |
| JP | H0749609 | A | | 2/1995 |
| JP | 08292708 | A | * | 11/1996 |
| JP | 2003084549 | A | * | 3/2003 |
| JP | 2007011079 | A | * | 1/2007 |
| KR | 1020060088414 | A | | 8/2006 |
| KR | 100738948 | B1 | | 7/2007 |
| WO | WO2012034502 | A1 | | 3/2012 |

* cited by examiner

COMBINATION CARTRIDGE

CROSS REFERENCE TO RELATED APPLICATIONS

This application is a U.S. National Stage Application which claims the benefit under 35 U.S.C. § 371 of International Patent Application No. PCT/US2018/048753 filed on Aug. 30, 2018, the contents of which are incorporated herein by reference.

BACKGROUND

Printing devices, such as printers, copiers, etc., may be used to form markings on a physical medium, such as text, images, etc. In some examples, imaging systems may form markings on the physical medium by performing a print job. A print job can include forming markings such as text and/or images by transferring print materials to the physical medium.

DETAILED DESCRIPTION

Figure 1:
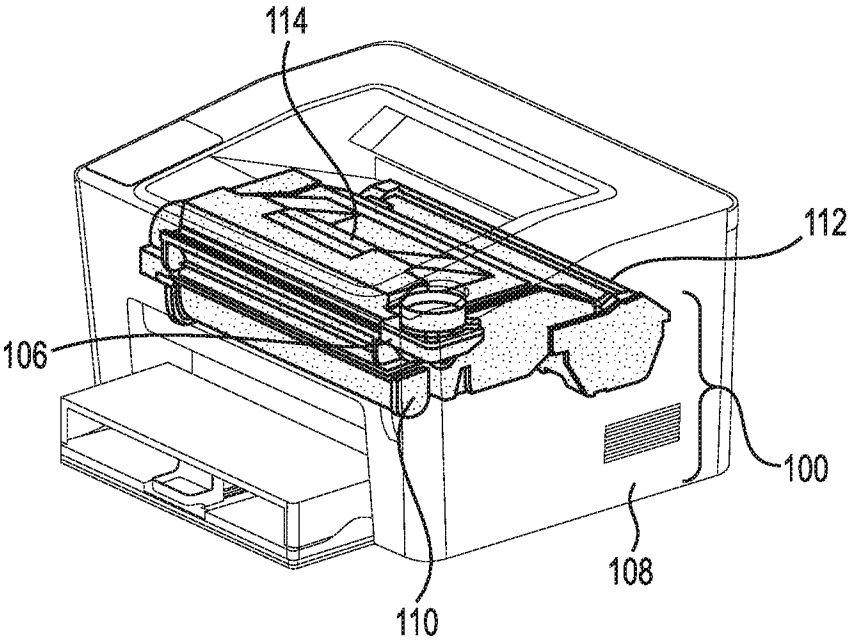
FIG. 1 illustrates a diagram of an example cartridge device according to the present disclosure.

Printing devices can include a supply of print materials including print material particles located in a container (e.g., a hopper, a reservoir, etc.). As used herein, the term "print materials" refers to a substance which, when applied to a medium, can form representation(s) on the medium during a print job. For example, print materials can include a toner material, liquid-based print materials, or other powder and/or particulate. In some examples, the print material particles can be deposited in successive layers to create three-dimensional (3D) objects. For example, print material particles can include a toner material, a powdered semi-crystalline thermoplastic material, a powdered metal material, a powdered plastic material, a powdered composite material, a powdered ceramic material, a powdered glass material, a powdered resin material, and/or a powdered polymer material, among other types of powdered or particulate material. The print material particles can be particles with an average diameter of less than one hundred microns. For example, the print material particles can be particles with an average diameter of between 0-100 microns. However, examples of the disclosure are not so limited. For example, print material particles can be particles with an average diameter of between 20-50 microns, 5-10 microns, or any other range between 0-100 microns. The print material particles can be fused when deposited to create 3D objects.

The print materials can be deposited onto a physical medium. As used herein, the term "printing device" refers to any hardware device with functionalities to physically produce representation(s) on the medium. In some examples, the printing device can be a laser printer, a scanning device, or a laser printer/scanner combination device, among others.

The container including the print materials may be inside of the printing device and include a supply of the print materials such that the printing device may draw the print materials from the container as the printing device creates the images on the print medium. As used herein, the term "container" refers to a reservoir, a hopper, a tank, and/or a similar vessel to store a supply of the print materials for use by the printing device.

As the printing device draws the print materials from the container, the amount of print materials in the container may deplete. As a result, the amount of print materials in the container of the printing device may have to be replenished.

A replenishment device may be utilized to fill and/or refill the container of the printing device with print materials, During a fill and/or refill operation, the replenishment can transfer print materials from the print materials supply to the container of the printing device.

Some approaches to print materials container replenishment can include replacing a combination toner cartridge, replacing a developer and toner cartridge, replacing a toner-only cartridge, or replacing a toner bottle. In such approaches, a printing device is opened, a cartridge or bottle is removed from the printing device, and a new cartridge is installed. In some approaches, the printing device may have more than one cartridge meaning a user is required to know which cartridge to remove and replace.

In other approaches, the cartridge or bottle is removed, replenished outside of the printing device, and returned to the printing device. This can be a messy process that can result in spills and/or contamination of an environment. Over- or under-filling of a cartridge or bottle may also occur due to user error or inefficient fill methods.

In contrast, examples of the present disclosure include a combination cartridge device that allows for replenishment of a print materials container in-situ. For instance, the print materials container can be coupled to an access port of the combination cartridge device that can receive a replenishment device. The replenishment device can replenish the print materials container in-situ such that the combination cartridge device, including the print materials container, remain within a printing device during replenishment. For instance, some examples of the present disclosure allow for replenishment of print materials in a manner that may be more convenient, faster, and simpler for a user as compared to other approaches. A combination cartridge device can be replenished in some examples. As used herein, a combination cartridge device includes a cartridge device having a plurality of components or functions in a single unit. For instance, in contrast to stand-alone cartridges, a combination cartridge device can include a print materials container and/or a waste collection container, along with components such as an organic photo conductor drum (OPC) and a developer roller. In some examples, the combination cartridge device can include an additional print materials container and/or an additional waste collection container.

By replenishing the cartridge device in-situ using a replenishment device, printing and/or operating costs (e.g., costs-per-page) can be reduced because a replenishment device is sufficient for refilling a print materials container. Because the replenishment device may not include gears, motors, electronics, etc., the cost to make and distribute the replenishment device may be reduced. This reduction can result in cost savings for a user. A combination cartridge device may have a longer life expectancy as compared to other approaches because components may not be removed for a longer period of time. For instance, because print materials can be replenished while the combination cartridge remains in a printing device, the combination cartridge may last 25,000 pages or longer, as compared to other cartridges with smaller capacities.

FIG. 1 illustrates a diagram of an example cartridge device 100 according to the present disclosure. Cartridge device 100, in some examples, can be a combination cartridge device. For instance, cartridge device 100 can include a plurality of components including an access port 106 coupled to a reserve print materials container 114. Access port 106, in some examples can be located outside of printing device 108 and/or can have a removeable or retractable cover. As used herein, "coupled to" can include being a part of and/or being connected to directly or indirectly. For instance, access port 106 can be a part of reserve print materials container 114, in some examples.

Reserve print materials container 114 can receive print materials directly from a replenishment device via access port 106. This can happen in-situ in some instances such that cartridge device 100 remains inside of printing device 108 while reserve print materials container 114 is replenished. As used herein, replenishment refers to the filling or refilling of a container. For instance, the reserve print materials container can be partially or completely filled or refilled with print materials (e.g., toner or other print material particles) by the replenishment device.

In some examples cartridge device 100 can be a combination cartridge device such that it includes an OPC (not illustrated in FIG. 1), a main print materials container (e.g., to receive print materials from reserve print materials container 114) a first waste collection container 112, a second waste collection container 110, and/or a development roller (not illustrated in FIG. 1), among other components (e.g., gears, brushes, etc.). In some instances, printing device 108 is a laser printer, and the print materials is toner. However, other printing devices and print materials may be used.

In the example illustrated in FIG. 1, printing device 108 is represented as being transparent to illustrate elements housed within printing device 108. For example, reserve print materials container 114, first waste collection container 112, and second waste collection container 110 are within printing device 108, while access port 106 is outside of printing device 108. In some examples, elements such as an OPC, a developer roller, a main print materials container, and other components are housed within printing device 108.

Figure 2:
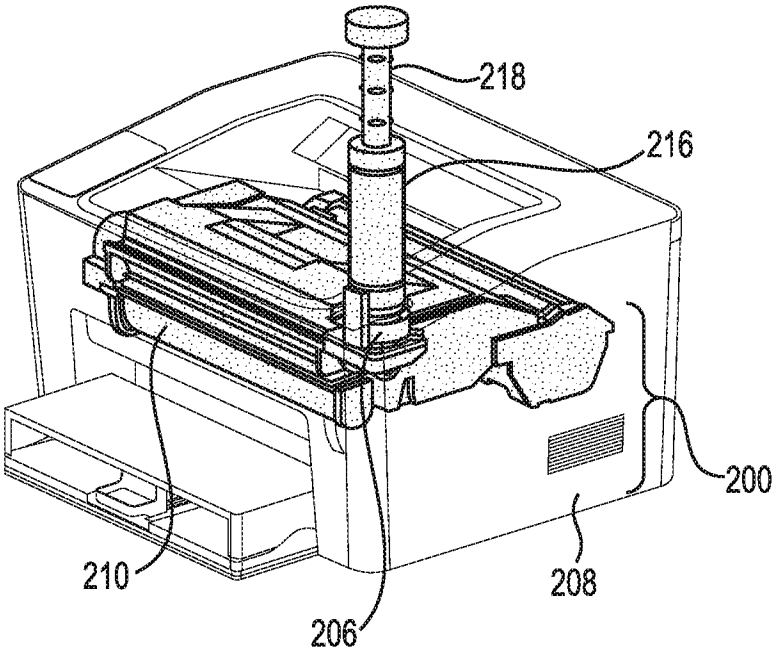
FIG. 2 illustrates a diagram of an example cartridge device coupled to a replenishment device according to the present disclosure.

FIG. 2 illustrates a diagram of an example cartridge device 200 coupled to a replenishment device 216 according to the present disclosure. For instance, FIG. 2 illustrates a system including a replenishment device 216 and a combination cartridge device 200 comprising an OPC (not illustrated in FIG. 2), a developer roller (not illustrated in FIG. 2), a main print materials container (not illustrated in FIG. 2), a waste collection container 210, and an access port 206 coupled to the main print materials container to receive print materials directly from replenishment device 216 in situ. For instance, the main print materials container can receive the print materials while combination cartridge device 200 remains in printing device 208.

In some examples, replenishment device 216 can be resiliently coupled to access port 206. The coupling can be resilient, such that the coupling is releasable, removable, detachable, etc. For instance, the coupling of replenishment device 216 to access port 206 may not be a permanent coupling. For example, replenishment device 216 can be locked and unlocked from access port 206. Replenishment device 216 can be resiliently coupled to access port 206 via an interlocking connection. For instance, replenishment device 216 can be coupled, or "locked" to access port 206 by connecting replenishment device 216 to access port 206 and turning and/or twisting replenishment device 216. In some examples, replenishment device 216 may be turned and/or twisted a particular amount, for instance, 180 degrees. Other degree amounts or directions may be used, for instance a range of degrees or different coupling approaches. The interlocking connection can include the opening of valve doors on replenishment device 216 and/or access port 206 to allow for transfer of print materials while avoiding spillage or spraying of print materials. Other interlocking connections and/or other coupling techniques may be used to couple replenishment device 216 to access port 206.

Replenishment device 216, in some examples, can house print materials for replenishing the main print materials container and can include a plunger mechanism 218 for deployment of print materials into the main print materials container. Deployment can include, for example, the plunger mechanism creating and/or applying pressure or force to the print materials causing the expulsion of the print materials out of replenishment device 216 and into the main print materials container. For instance, replenishment device 216 can be preloaded with print materials, and upon release of a stopper (e.g., a pull tab, etc.), the plunger mechanism 218 can deploy print materials into the main print materials container.

Upon completion of deployment (e.g., all print materials deployed into the main print materials container), plunger mechanism 218 can be locked or remains in a fixed position. By locking plunger mechanism 218 or leaving it in a fixed position, extra air may be prevented from entering the main print materials container. Upon release from access port 206, plunger mechanism 218 can be unlocked and/or replenishment device 216 may be refilled or discarded. In some examples, locking plunger mechanism 218 can render replenishment device 216 inoperable, such that replenishment device 216 is a single-use replenishment device. In some examples, plunger mechanism 218 can include a plunger arm, force leverage mechanism, or force receiving mechanism, among others.

In the example illustrated in FIG. 2, printing device 208 is represented as being transparent to illustrate elements housed within printing device 208. For example, waste collection container 210 is housed within printing device 208, while access port 206, replenishment device 216, an plunger mechanism 218 are outside of printing device 208. In some examples, elements such as an OPC, a developer roller, a reserve print materials container, a main print materials container, and other components are housed within printing device 208.

Figure 3:
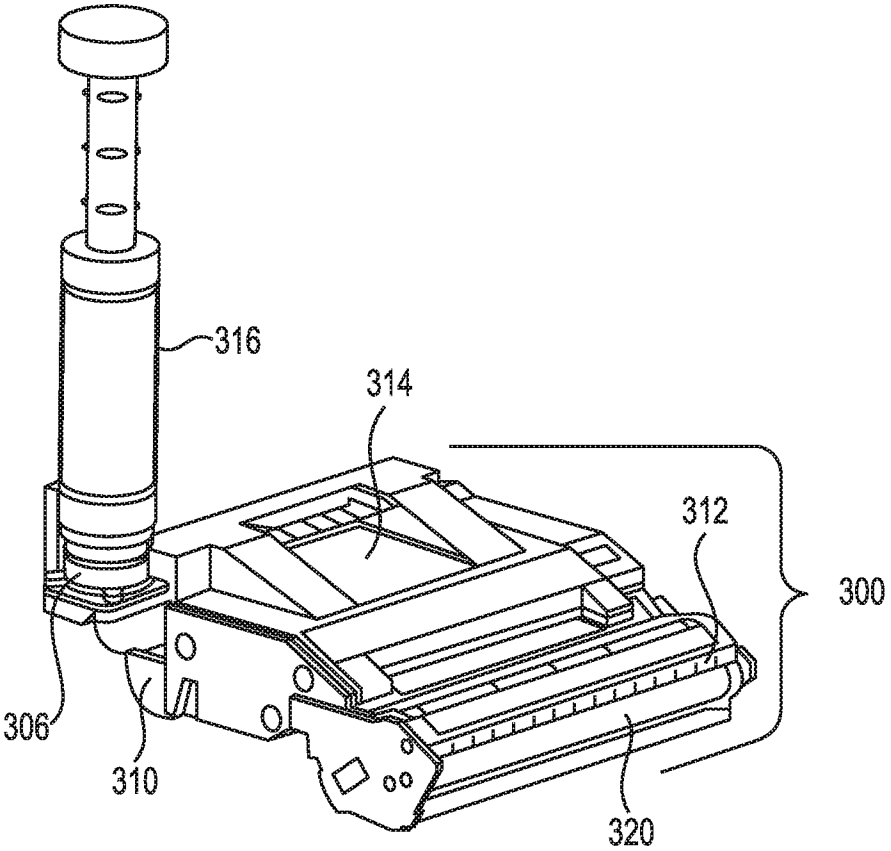
FIG. 3 illustrates another diagram of an example cartridge device coupled to a replenishment device according to the present disclosure.

FIG. 3 illustrates another diagram of an example cartridge device 300 coupled to a replenishment device 316 according to the present disclosure. Cartridge device 300 is illustrated outside of a printing device for ease of illustrate in FIG. 3 but may be located within a printing device. In the example illustrated in FIG. 3, access port 306 and replenishment device 316 would be located outside of the printing device, while elements 310, 312, 314, and 320, as will be discussed further herein, would be locate inside of the printing device.

Cartridge device 300 can be a combination cartridge device including, for instance, access port 306, reserve print materials container 314, first waste collection container 312, second waste collection container 310, and OPC 320. In some examples, cartridge device 300 may include a developer roller (not illustrated in FIG. 3) and a main print materials container (not illustrated in FIG. 3), among other components. Replenishment device 316 can be resiliently coupled to cartridge device 300 via access port 306.

In some examples OPC 320 can be resiliently coupled to cartridge device 300. The coupling can be resilient, such that the coupling is releasable, removable, detachable, etc. For instance, the coupling of OPC 320 cartridge device 300 may not be a permanent coupling. In such an example, OPC 320 may be separated from cartridge device 300 for replacement of OPC 320 or cartridge device 300. Such an approach can reduce replacement costs and/or shipping costs, among others. In an example in which OPC 320 is resiliently coupled to cartridge device 300, OPC 320 may be part of a combination cartridge device and no components of the combination cartridge device are removed during replenishment of a reserve print materials container 314 or a main print materials container of the combination cartridge device.

In some examples other components may be resiliently coupled to cartridge device 300. For instance, the developer roller and/or waste collection containers may be resiliently coupled. In some examples, the main print materials container may be resiliently coupled to the developer roller, OPC 320, and a waste collection container. In some instances, the main print materials container may be resiliently coupled to OPC 320, but permanently coupled to the developer roller. Other combinations of resilient and permanent coupling are possible.

Figure 4:
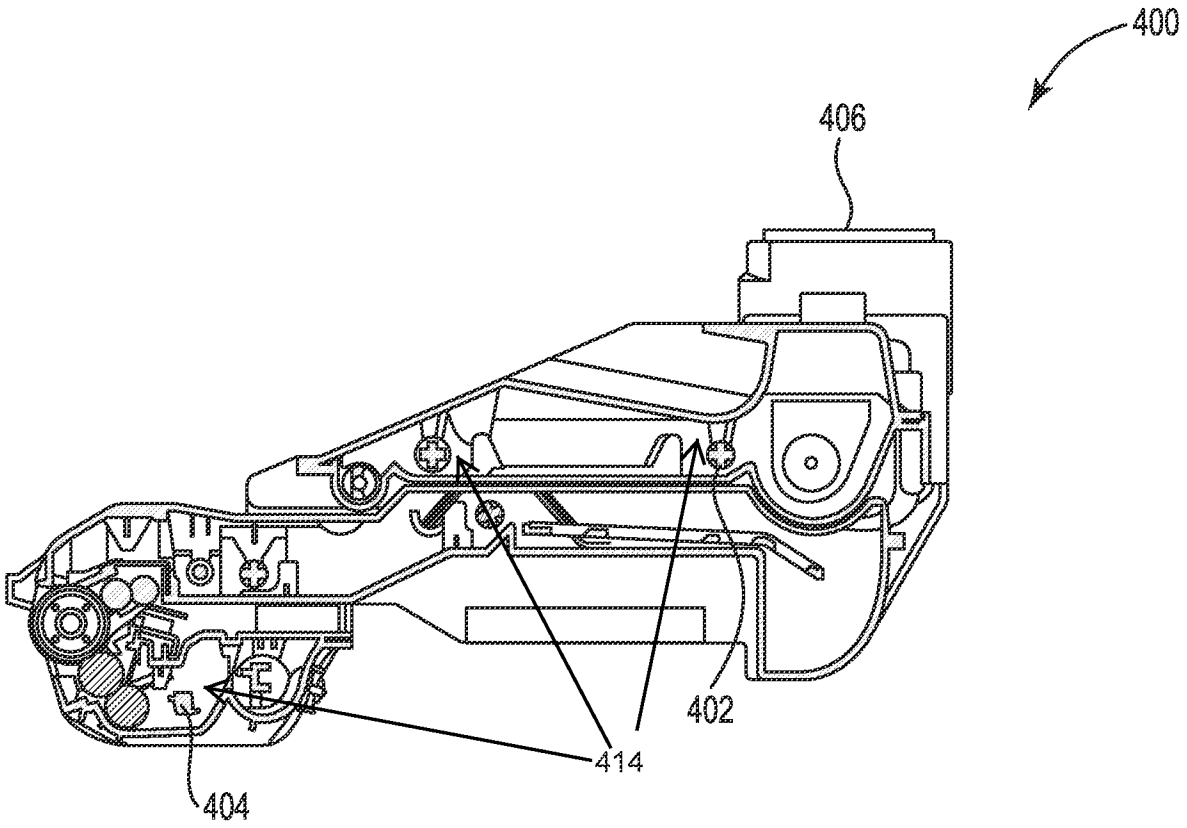
FIG. 4 illustrates a diagram of an example cartridge device including a reserve print materials container and a main print materials container according to the present disclosure.

FIG. 4 illustrates a diagram of an example cartridge device 400 including a reserve print materials container 402 and a main print materials container 404 according to the present disclosure. Cartridge device 400 can be a combination cartridge device such that it includes reserve print materials container 402 to receive print materials from a replenishment device resiliently coupled to cartridge device 400 via access port 406. Print materials can be moved from reserve print materials container 402 to main print materials container 404 for use in a print job. For instance, a belt or other print materials transfer system 414 can be used to move print materials from reserve print materials container 402 to main print materials container 404. A same belt, a different belt, and/or a plurality of belts 414 may agitate print materials in main print materials container 404 and reserve print materials container 402 in some instances. In some examples, reserve print materials container 402 may not be present, and main print materials container 404 can be replenished via access port 406 by a replenishment device.

In some examples, reserve print materials container 402 can supply main print materials container 404 with print materials in response to an indication of the print materials falling below a threshold in main print materials container 404. For instance, if main print materials container 404 has a print materials capacity of 25,000 sheets, and reserve print materials container 402 has a print materials capacity of 5; 000 sheets, an indication may occur when print materials falls below 20,000 sheets, 15,000 sheets, 10,000 sheets, and/or 5,000 sheets in main print materials container 404. Other thresholds may be set by a manufacture or a user, in some instances. Other capacities may be possible in some examples for main print materials container 404 and reserve print materials container 402. In some examples, reserve print materials container 402 can supply main print materials container 404 automatically or in response to user input. As used herein, "automatically" can include main print materials container being supplied by reserve print materials container 402 with limited or no user input and/or with limited or no prompting (other than the threshold indication).

The threshold indication can be prompted by sensors (e.g.; optical sensors) within cartridge device 400 and/or main print materials container 404 and/or reserve print materials container 402 that can detect print materials levels. In some examples, a combination cartridge may not include a reserve print materials container. In such an example, main print materials container 404 receives print materials directly from a replenishment device via access port 406.

In some instances, a user may be alerted that print materials in reserve print materials container 402 and/or main print materials container 404 has fallen below a threshold. In such an example, a user may use a replenishment device to replenish reserve print materials container 402 if present in the combination cartridge device or main print materials container 404 if no reserve print materials container is present in the combination cartridge device. No components of the combination cartridge device are removed for/during replenishment.

Figure 5:
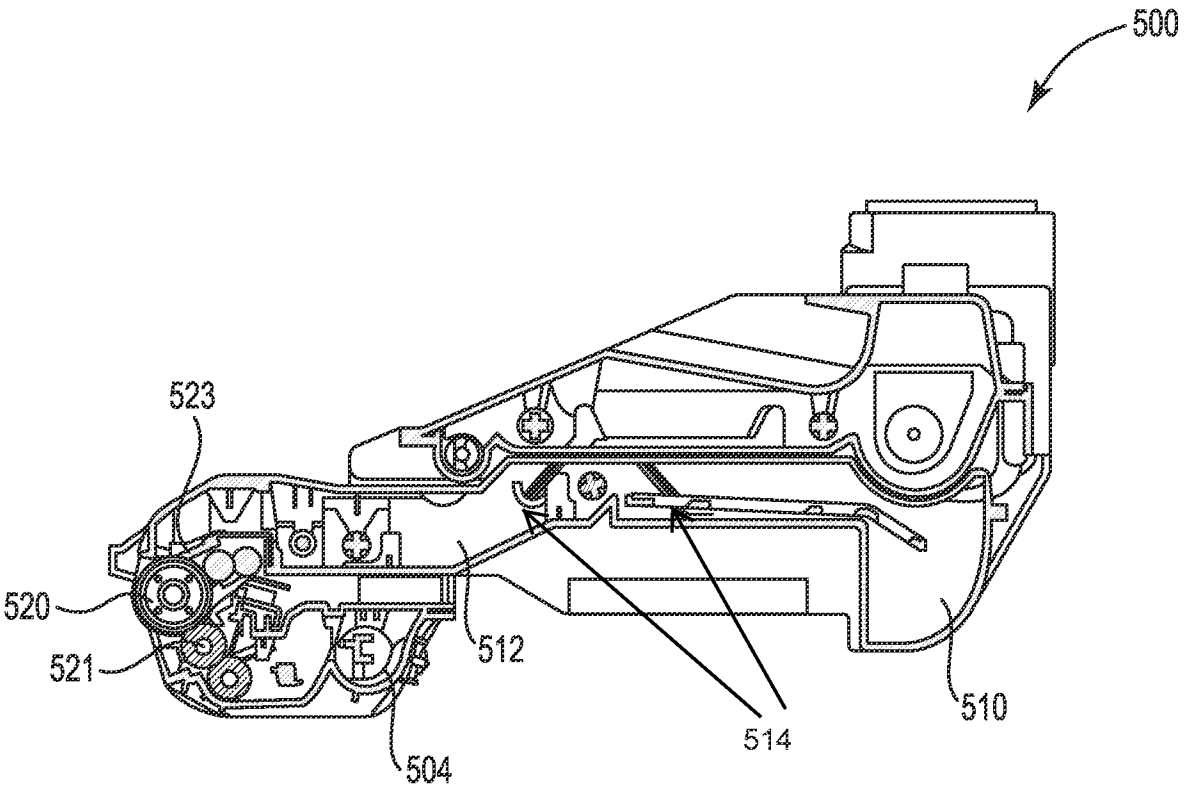
FIG. 5 illustrates a diagram of an example cartridge device including a first waste collection container and a second waste collection container according to the present disclosure.

FIG. 5 illustrates a diagram of an example cartridge device 500 including a first waste collection container 512 and a second waste collection container 510 according to the present disclosure. Cartridge device 500 can be a combination cartridge device such that it includes first waste collection container 512 to collect and/or store waste and second waste collection container 510 to store waste moved from first waste collection container 512. For instance, during a print job, first waste collection container 512 may collect waste. Waste can include, for example, print materials waste, medium waste, and/or a by-product realized or produced during a printing process or other printing device function.

This collected waste can be moved, for instance using a belt or other waste transfer system 514, to second waste collection container 510 for storage. Having second waste collection container 510 to store waste can allow for storage of more waste as compared to other approaches, meaning removal of waste collection containers may not be necessary. Waste collection containers 510 and 512 can be part of the combination cartridge device, such that they may not be removable.

In some examples, during a print job, as OPC 520 rotates and developer roller 521 picks up print materials from main print materials container 504, most of the print materials may be dropped onto the print job medium (e.g., paper), What is left, which can be referred to as "waste", can be caught by cleaning blade 523 and moved into first waste collection container 512. The waste can be moved (or free flow) into second waste collection container 510 for storage. Unprocessed toner print materials material, paper debris, dust, or other unwanted material can build up on the OPC and if not removed can cause printing defects when it inadvertently transfers to the print job medium. A cleaning blade, such as cleaning blade 523, can be implemented to gather up such material and collect it into a waste collection container such as first waste collection container 512, for instance.

In some examples, second waste collection container 510 can hold a larger amount of waste than first waste collection container 512 or waste collection containers in other print materials cartridges. For instance, in some examples, first waste collection container 512 and second waste collection container 510 can together hold 25,000 pages worth of waste, which can increase a lifetime of a combination cartridge device because the combination cartridge device does not have waste removed until 25,000 pages. For instance, if a replenishment device holds 2,500 pages worth of print materials, a combination cartridge device (e.g., its print materials containers) may be filled ten times before second waste collection container 510 is full. This can reduce spills and contamination issues as compared to other approaches that include frequent waste print materials container removals and/or disposals. While 25,000 pages and 2,500 pages are used herein as examples, other page amounts may be possible.

In some examples, cartridge device 500 includes a single waste collection container. In such an example, the waste collection container can be elongated and uses a conveyer mechanism to move waste from near OPC 520 to a larger storage waste collection container. For instance, in such an example, first waste collection container 510 and second waste collection container 512 may not be separate containers, but rather a single, elongated waste collection container. In other examples, the single waste collection container is not a same shape as a combination of first waste collection container 510 and second waste collection container 512, In some examples, no waste collection container is present in cartridge device 500.

Figure 6:
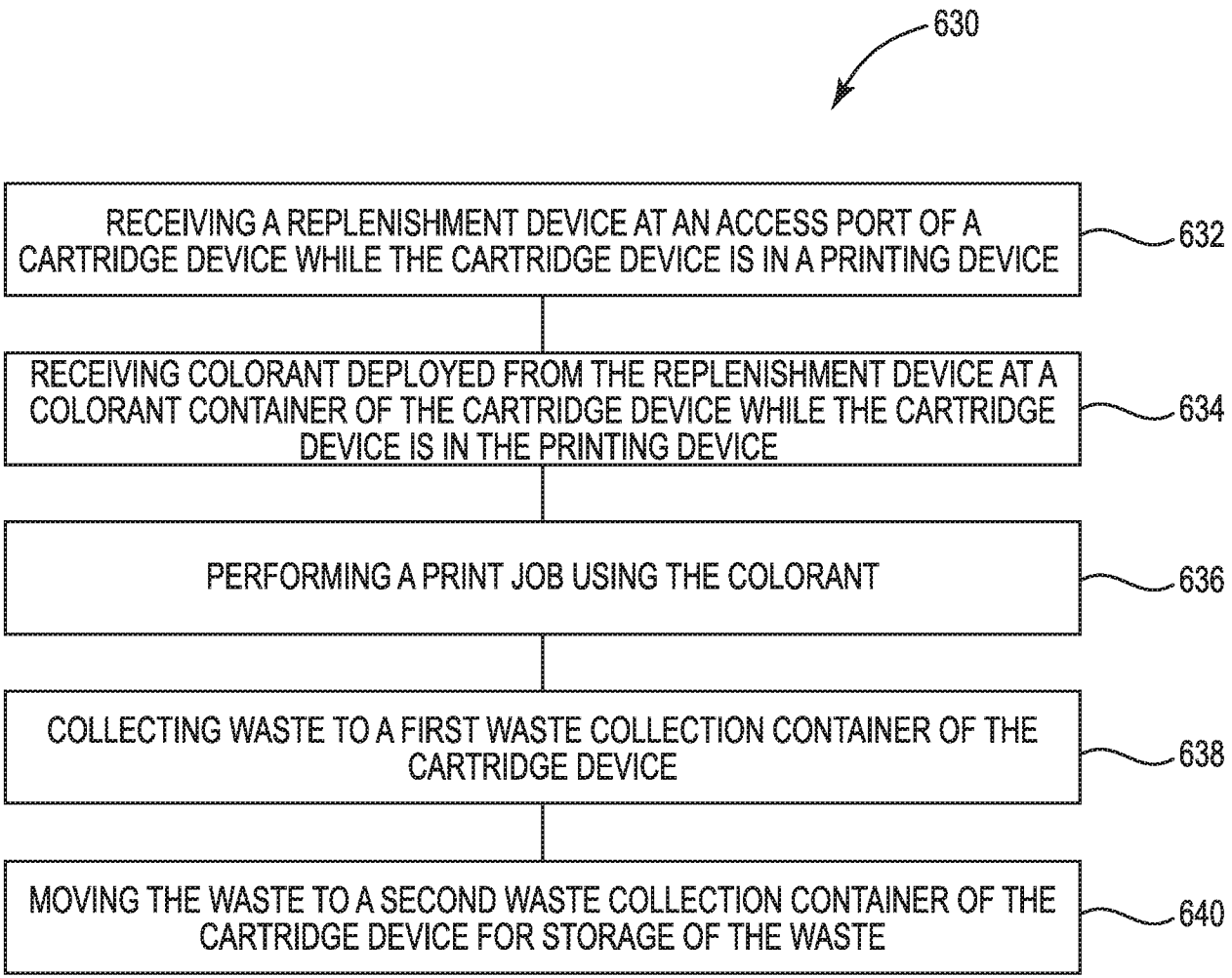
FIG. 6 illustrates a flow diagram of an example method for print materials container replenishment according to the present disclosure.

FIG. 6 illustrates a flow diagram of an example method 630 for print materials container replenishment according to the present disclosure. At 632, method 630 can include receiving a replenishment device at an access port of a cartridge device while the cartridge device is in a printing device. For instance, a replenishment device can be resiliently coupled to the access port such that the coupling allows for a contained release of print materials from the replenishment device. The cartridge device may not be removed from the printing device during coupling of the replenishment device.

At 634, method 630 can include receiving print materials deployed from the replenishment device at a print materials container of the cartridge device while the cartridge device is in the printing device. Print materials, for instance, can be received at a reserve print materials container and the print materials can be moved from the reserve print materials container to a main print materials container using a belt. The reserve print materials container, in some instances, can be used to store print materials until print materials in the main print materials container falls below a particular threshold. The cartridge device remains in the printing device during deployment of print materials. Put another way, print materials is deployed to an in-situ cartridge device.

Method 630, at 636, can include performing a print job using the print materials. During the print job or during other printing device operations, waste or other by-products may be produced. At 638, method 630 can include collecting waste to a first waste collection container of the cartridge device, and at 640, method 630 can include moving the waste to a second waste collection container of the cartridge device for storage of the waste. In some instances, the movement can be performed using a belt. The second waste collection container can store waste associated with more pages than the replenishment device can deploy. This can allow for a plurality of replenishments before removal of the second waste collection container is performed.

In the foregoing detailed description of the present disclosure, reference is made to the accompanying drawings that form a part hereof, and in which is shown by way of illustration how examples of the disclosure may be practiced. These examples are described in sufficient detail to enable those of ordinary skill in the art to practice the examples of this disclosure, and it is to be understood that other examples may be utilized and that process, electrical, and/or structural changes may be made without departing from the scope of the present disclosure.

The figures herein follow a numbering convention in which the first digit corresponds to the drawing figure number and the remaining digits identify an element or component in the drawing. Elements shown in the various figures herein can be added, exchanged, and/or eliminated so as to provide a number of additional examples of the present disclosure. In addition, the proportion and the relative scale of the elements provided in the figures are intended to illustrate the examples of the present disclosure and should not be taken in a limiting sense. Further, as used herein, "a" element and/or feature can refer to one or more of such elements and/or features.

What is claimed is:

1. A print materials cartridge for a print device, comprising:

a reserve print materials container to be disposed inside the print device, when the print materials cartridge is inserted into a cartridge opening of the print device;

an access port coupled to the reserve print materials container and to be located outside the print device through a replenishment opening of the print device, when the reserve print materials container is disposed inside the print device, to allow access to the reserve print materials container in situ by a detachable replenishment device from the outside, the replenishment device having a mechanism to apply force to deploy print materials from the replenishment device into the reserve print materials container through the access port; and a main print materials container coupled to the reserve print materials container to receive the print materials through the reserve print materials container from the detachable replenishment device.

2. The print materials cartridge of claim 1, wherein the print materials cartridge further comprises an organic photo conductor (OPC) drum resiliently coupled to the print materials cartridge.

3. The print materials cartridge of claim 1, wherein the reserve print materials container is to supply print materials to the main print materials container, in response to an indication of an amount of print materials falling below a threshold amount in the main print materials container.

4. The print materials cartridge of claim 1, wherein the print materials includes print material particles.

5. The print materials cartridge of claim 1, further comprising an organic photo conductor (OPC) drum.

6. The print materials cartridge of claim 5, further comprising:

a waste collection container, and a developer roller.

7. A print device comprising:

the print materials cartridge according to claim 1.

8. A system, comprising:

a print materials cartridge to be inserted into a cartridge opening of a print device, comprising:

an organic photo conductor (OPC) drum;

a developer roller;

a reserve print materials container to be disposed inside the print device, when the print materials cartridge is inserted into the cartridge opening;

a main print materials container to couple to the reserve print materials container to receive print materials from the reserve print materials container, when the print the print materials cartridge is inserted into the cartridge opening; and an access port coupled to the reserve print materials container and located outside the print device through a replenishment opening of the print device to allow access to print materials to be deployed into the reserve print materials container in situ from the outside the print device; and a replenishment device resiliently couplable from the outside to the access port through the replenishment opening and having a mechanism to apply force to deploy print materials from the replenishment device into the reserve print materials container, to replenish the print materials of the main print materials container through the reserve print materials container in-situ from the detachable replenishment device.

9. The system of claim 8, wherein the mechanism to apply force to deploy print materials includes a plunger mechanism to apply force to deploy print materials outside the print device from the replenishment device into the main print materials container.

10. The system of claim 8, further comprising a waste collection container to collect and store waste.

11. The system of claim 8, wherein the replenishment device is resiliently couplable to the access port via an interlocking connection.

12. The system of claim 8, wherein the print materials cartridge further comprises a plurality of waste collection containers.

13. The system of claim 8, wherein:

the mechanism is to be locked from moving print materials upon completing deploying print materials.

14. The system of claim 8, further comprising a transfer system to move print materials from the reserve print materials container to the main print materials container.

15. A method, comprising:

coupling, from outside of a print device through a replenishment opening of the print device, a detachable replenishment device to an access port coupled to a reserve print materials container of a print materials cartridge disposed inside the print device, the coupled access port located outside the print device to allow access to the reserve print materials container in situ by the replenishment device, when the print materials cartridge is inserted into a cartridge opening of the print device; and causing print materials to be deployed from the replenishment device including a mechanism to apply force to deploy the print materials through the access port into the reserve print materials container, the print materials is moved from the reserve print materials container to a main print materials container.

16. The method of claim 15, wherein the moving the received print materials from the reserve print materials container to the main print materials container further comprises moving the received print materials using a transfer system.

17. The method of claim 15, further comprising:

performing a print job using the print materials;

collecting waste to a first waste collection container of the print materials cartridge; and moving the waste to a second waste collection container of the print materials cartridge for storage of the waste.

18. The method of claim 17, wherein the moving the waste to the second waste collection container includes moving the waste using a transfer system.

* * * * *